US006490844B1

(12) United States Patent
Jones

(10) Patent No.: US 6,490,844 B1
(45) Date of Patent: Dec. 10, 2002

(54) FILM WRAP PACKAGING APPARATUS AND METHOD

(75) Inventor: William Charles Jones, Osterville, MA (US)

(73) Assignee: Emerging Technologies Trust, Osterville, MA (US)

( * ) Notice: Subject to any disclaimer, the term of this patent is extended or adjusted under 35 U.S.C. 154(b) by 19 days.

(21) Appl. No.: 09/886,794

(22) Filed: Jun. 21, 2001

(51) Int. Cl.[7] ..... B65B 41/18; B65B 51/10; B65B 53/60

(52) U.S. Cl. ..... 53/441; 53/176; 53/556; 53/373.7; 53/374.3

(58) Field of Search ..... 53/176, 556, 228, 53/229, 374.3, 373.7, 587, 586, 209, 211, 441, 465

(56) References Cited

U.S. PATENT DOCUMENTS

| | | | |
|---|---|---|---|
| 1,797,568 | A | 3/1931 | Dean |
| 1,936,951 | A | 11/1933 | Peterson |
| 2,031,381 | A | 2/1936 | McCallum |
| 2,124,329 | A | 7/1938 | Zimmerman |
| 2,541,203 | A | 2/1951 | Canfield |
| 2,707,553 | A | 5/1955 | Yount |
| 2,745,545 | A | 5/1956 | Dunning |
| 2,802,565 | A | 8/1957 | Kabbash |
| 2,919,797 | A | 1/1960 | McCracken |
| 2,959,277 | A | 11/1960 | Strange |
| 2,980,245 | A | 4/1961 | Stoker, Jr. |
| 3,089,590 | A | 5/1963 | Mell |
| 3,107,394 | A | 10/1963 | Varon |
| 3,161,915 | A | 12/1964 | Thiel |
| 3,294,301 | A | 12/1966 | Richter |
| 3,333,032 | A | 7/1967 | Dickinson |
| 3,335,927 | A | 8/1967 | Zwiebel |
| 3,424,306 | A | 1/1969 | Munck |
| 3,434,646 | A | 3/1969 | Schmidt |
| 3,454,693 | A | 7/1969 | Crenshaw |
| 3,507,383 | A | 4/1970 | Rorer |
| 3,540,579 | A | 11/1970 | Hellstrom |
| 3,562,999 | A | 2/1971 | Barbedienne |
| 3,577,700 | A | 5/1971 | Bensheim et al. |
| 3,667,885 | A | 6/1972 | Shelby |
| 3,669,337 | A | 6/1972 | Struble |
| 3,718,275 | A | 2/1973 | Willinger |
| 3,733,160 | A | 5/1973 | Neil |
| 3,770,118 | A | 11/1973 | Jones |
| 3,830,611 | A | 8/1974 | Irwin |
| 3,867,085 | A | 2/1975 | Lynch |
| 3,867,088 | A | 2/1975 | Brown et al. |
| 3,868,209 | A | 2/1975 | Howell |
| 3,891,090 | A | 6/1975 | Spiegel et al. |
| 3,904,338 | A | 9/1975 | Straumanis |
| 3,905,474 | A | 9/1975 | Haibara |
| 3,925,140 | A | 12/1975 | Brown |
| 3,966,046 | A | 6/1976 | Deutschlander |
| 4,018,028 | A | 4/1977 | Donnet |
| 4,030,603 | A | 6/1977 | Angell |
| 4,075,818 | A | 2/1978 | Wright et al. |
| 4,086,045 | A | 4/1978 | Thiel et al. |
| 4,105,386 | A | 8/1978 | Thiel et al. |

(List continued on next page.)

FOREIGN PATENT DOCUMENTS

| | | |
|---|---|---|
| CA | 691904 | 8/1964 |
| GB | 1 266 593 | 3/1972 |
| JP | 49-59982 | 6/1974 |

(List continued on next page.)

*Primary Examiner*—Anthony Stashick
(74) *Attorney, Agent, or Firm*—Leslie Meyer-Leon, Esq.; IP Legal Strategies Group P.C.

(57) ABSTRACT

A packaging apparatus for forming a film about a foldable sheet material and an article immobilized on the base portion of the sheet material. The sheet material and article on a load board are moved sequentially by the apparatus through a load station, a film wrap station and a film seal and cut station.

9 Claims, 4 Drawing Sheets

U.S. PATENT DOCUMENTS

| | | | | | |
|---|---|---|---|---|---|
| 4,128,369 | A | | 12/1978 | Kemerer et al. | |
| 4,166,348 | A | * | 9/1979 | Carlson | 53/556 |
| 4,267,140 | A | | 5/1981 | Meeker | |
| 4,285,432 | A | | 8/1981 | de Villers et al. | |
| 4,306,653 | A | | 12/1981 | Fales | |
| 4,307,804 | A | | 12/1981 | Benham | |
| 4,451,249 | A | | 5/1984 | deBin | |
| 4,494,689 | A | | 1/1985 | Ilitch | |
| 4,552,709 | A | | 11/1985 | Koger, II et al. | |
| 4,555,377 | A | | 11/1985 | Whiteside et al. | |
| 4,620,408 | A | * | 11/1986 | Parnes | 53/556 |
| 4,748,791 | A | | 6/1988 | Langenbeck | |
| 4,757,900 | A | | 7/1988 | Misset et al. | |
| 4,778,372 | A | | 10/1988 | Mutti et al. | |
| 5,015,430 | A | | 5/1991 | Suzuki et al. | |
| 5,086,925 | A | | 2/1992 | Coalier et al. | |
| 5,167,781 | A | | 12/1992 | Kemerer et al. | |
| 5,226,542 | A | | 7/1993 | Boecker et al. | |
| 5,323,896 | A | | 6/1994 | Jones | |
| 5,325,967 | A | | 7/1994 | Gonzales | |
| 5,341,931 | A | | 8/1994 | Prochaska et al. | |
| 5,382,148 | A | | 1/1995 | Buckley | |
| 5,388,701 | A | | 2/1995 | Ridgeway | |
| 5,404,691 | A | * | 4/1995 | Scherer | 53/556 |
| 5,407,076 | A | | 4/1995 | Sabet | |
| 5,473,861 | A | * | 12/1995 | Fukunaga et al. | 53/228 |
| 5,518,119 | A | | 5/1996 | Takahashi | |
| 5,524,420 | A | | 6/1996 | Ikuta | |
| 5,579,917 | A | | 12/1996 | Lofgren et al. | |
| 5,620,715 | A | | 4/1997 | Hart et al. | |
| 5,657,618 | A | | 8/1997 | Dall'Omo et al. | |
| 5,669,506 | A | | 9/1997 | Lofgren et al. | |
| 5,673,542 | A | * | 10/1997 | Vartanian et al. | 53/556 |
| 5,675,958 | A | | 10/1997 | Shanklin et al. | |
| 5,676,245 | A | | 10/1997 | Jones | |
| 5,678,695 | A | | 10/1997 | Ridgeway et al. | |
| 5,683,340 | A | | 11/1997 | Belias et al. | |
| 5,694,744 | A | | 12/1997 | Jones | |
| 5,722,541 | A | | 3/1998 | Lofgren et al. | |
| 5,765,693 | A | | 6/1998 | Gnadt et al. | |
| 5,769,235 | A | | 6/1998 | Keach et al. | |
| 5,876,317 | A | | 3/1999 | Sigrist et al. | |
| 5,893,462 | A | | 4/1999 | Ridgeway | |
| 5,957,821 | A | | 9/1999 | Scharbrodt et al. | |
| 5,967,327 | A | | 10/1999 | Jones | |
| RE36,412 | E | | 11/1999 | Jones | |
| 5,975,294 | A | | 11/1999 | His-Chang | |
| 5,975,307 | A | | 11/1999 | Harding et al. | |
| 5,993,593 | A | | 11/1999 | Swartz et al. | |
| 6,047,831 | A | | 4/2000 | Jones | |
| 6,073,761 | A | | 6/2000 | Jones | |
| 6,129,538 | A | | 10/2000 | Jones | |
| 6,164,046 | A | | 12/2000 | Werner et al. | |
| 6,189,302 | B1 | * | 2/2001 | Kudo et al. | 53/228 |
| 6,234,943 | B1 | | 5/2001 | Copin | |
| 6,264,591 | B1 | | 7/2001 | Keen et al. | |
| 6,308,828 | B1 | | 10/2001 | Jones | |
| 6,318,053 | B1 | * | 11/2001 | Frank et al. | 53/586 |

FOREIGN PATENT DOCUMENTS

| | | |
|---|---|---|
| JP | 49-77087 | 7/1974 |
| JP | 50-88376 | 7/1975 |
| JP | 50-102778 | 8/1975 |
| JP | 50-107583 | 8/1975 |
| JP | 57-177969 | 11/1982 |
| JP | 3-100158 | 4/1991 |
| WO | WO 95/00410 | 1/1995 |
| WO | WO 98/18694 | 5/1998 |

* cited by examiner

FILM SEAL STATION

FILM WRAP PACKAGING APPARATUS AND METHOD

BACKGROUND OF THE INVENTION

There are a wide variety of packaging kit systems and methods for securely immobilizing and packaging articles. Various methods have included the use of corrugated frames, fitted components prepared from polyurethane foam, and loose foam-type materials prepared from expandable polystyrene. Also available for protecting articles are foam or bubble wraps which have flexible foam sheets with a plurality of air-formed bubbles, or foam sheets which are wrapped about an article to be secured by die cut, corrugated cardboard, where the corrugated cardboard is die cut and then folded in a particular shape to form a cap or tray to contain the article to be packaged and shipped.

U.S. Pat. No. Re. 36,412, issued Nov. 30, 1999 (hereby incorporated by reference in its entirety) discloses a film tube or sleeve means, dimensioned and adapted to be pulled into a loosely fit position about a base sheet material in a generally loose-type fit when the sheet material is in a non-use position, and to fit closely in a huggable-type manner about the article when the base portion is used to immobilize the article. This permits the article to be immobilized and to be inserted between the base portion and the interior of the film tube when the base is in the folded article insertion position, and then when the end portions of the base are folded the sheet material is returned to a generally flat planar position. This movement immobilizes the article on the base portion by causing the film tube or sleeve means to stretch over the article and to hold the article in place on the base portion. The disadvantage of this system is that it does not easily accommodate variations in the size and shape of the article to be packaged, particularly when packaging small and/or flat articles which are prone to moving or sliding within the finished packaging.

It is desired to provide a system, apparatus and method for packaging articles of varying sizes and shapes on a base or sheet material, so as to minimize or prevent undue movement or sliding of the article within the package. It is further desired to provide a packaging system with an in situ, formed film so as to customize the size of the film tube to the size and shape of each article and to accelerate the packaging process, to form a film as required and to reduce the manual labor and cost of the packaging.

SUMMARY OF THE INVENTION

The invention is directed to a packaging kit, system, apparatus and method for immobilizing an article within a package, particularly odd-shaped, fragile articles. A film is formed in situ over or around the article placed on a base sheet material so as to form a cover or tube of film around the packaged product. Preferably, the invention relates to a film wrap package apparatus and method wherein a film is formed automatically about the base sheet material and article.

The system includes components for wrapping film around an article. The components of the system are positioned to create, in sequence and without limitation, an article load station, a film wrap station, a film seal station, and a recovery station for removing the film immobilized article on the base sheet material from the system. Preferably, all components can optionally be encompassed within a single apparatus. Alternatively, the system includes a set of modular components.

An article load station includes a moveable load board, generally configured to receive thereon a base sheet material or blank having a longitudinal fold line. Preferably, the load board is angular, or V-shaped, to confer an angular or V-shape on the base sheet material. When the film-surrounded base sheet material and article are later removed from the load board, flattening of the base sheet material confers tension on the film surround. The longitudinal fold line can be in a central position on the base sheet material, or can be off-center. The article is placed on the base portion of the blank sheet material on the load board. By "base portion" is meant that portion of the base sheet material that is co-planar and contiguous with the article placed thereon.

In the film wrap station position, the load board and article, or the load board alone, are moved toward the seal bed. Movement is within a film curtain to wrap and stretch the film over the top of the load board and article, and to apply tension to the film prior to sealing the film. Where the arm is a pivotable arm, the arm rotates the load board toward the seal bed, so as to place the seal edge in plane with the seal arm. Where the arm is moved laterally toward the seal arm, the seal bed can be moved upward to meet the seal edge.

At the film seal station position, the load board and article with the tensioned film thereover are moved toward the seal bed, and the film is sealed. In one embodiment, where the system components are parts of a single apparatus, the load board is rotated toward the seal bed. Alternatively, the arm holding the load board can be moved laterally toward the seal bed. Preferably, the film is sealed by heat sealing opposing layers of film. By sealing the film, a cover, tube, wrap or surround of film is formed about the load board, with the heat seal at the trailing edge of the film. This separates the trailing edge of the sealed film from the leading edge of the film that is to be sealed around the next article that is packaged by the system.

The system further includes an article recovery station where the package, including the article enclosed within the film on the sheet material, is removed from the system, and the end flaps of the sheet material are folded up or down. This straightens the planar surface of the sheet material and immobilizes the article in position. The folded-up sheet material and immobilized article are then removed, and optionally, placed in a packaging container, such as an outer carton, with the end flaps down to position the article above the surface of the carton, or with the end flaps up to provide end protection for the immobilized article.

The invention further relates to a packaging apparatus for tension-film wrap of an article to be packaged on a product base, which system includes an article load station which comprises an arm, e.g., a pivotable or lateral arm, having a one and other end and arranged and constructed to, e.g., pivot at one end in a generally lateral, arcuate pivotable movement between a product load station, a film wrap station, and a film seal station. An article load platform at the other end of the arm receives a product base thereon and receives a product to be packaged on the platform-supported product base. The apparatus also includes a film wrap station which includes a roll source, or source of a thermoplastic film material, to be used to tension-film wrap the product on the product base supported on the platform at the film wrap station, and the film material from the roll arranged and constructed to form a film curtain about the platform at the product load station and film wrap station and to extend the film material in a stretched tension position over the top of the product and base at the film wrap station.

The apparatus further includes a film seal station which includes a seal bed and a seal arm which move between an open, non-seal position to permit the passage of film material, and a closed, seal position to seal the film material and form a film about the product and product base and to sever the sealed film material at a trailing end of the film material to provide a film-wrapped product and to form a sealed leading edge of the film material for the next product to be packaged. Further, the apparatus includes a means to move the pivotable arm sequentially between the stations with the platform spaced apart from one side of the roll source and within the film curtain at the product head station. The platform, product base, and product are positioned generally directly over the roll source at the film wrap station. In this manner, the film material is tension-stretched over the product and product base at one edge of the product and over another edge of the product as the pivotable arm moves to the film seal station. A film wrapped product on the platform is spaced apart on the other side of the roll source to permit the film material's trailing edge to be sealed and cut to produce a film wrap over the product and product base on the support platform for removal.

A method of film packaging a product on a product base includes providing an arm with a load platform at one end, surrounding the arm with a film curtain of an elastic, thermoplastic film material, placing a product base on the platform, placing a product to be packaged on the product base, moving, e.g., pivotably rotating, the arm and platform with the product base and product to stretch the film material across the top of the package; sealing together two layers of the film material adjacent one edge of the product base to form a film about the product, the other edge of film sealed in a previous packaging setup to provide a film-wrapped product; severing the sealed two layers to mount the film curtain; and removing the film-wrapped product or the product base from the platform.

The invention relates to a packaging apparatus for the tension-wrap of an article within a film on a base sheet material. The apparatus includes a load board to receive a base sheet material and an article to be packaged; a roll source of a thermoplastic film material; a means to form a surrounding curtain of the thermoplastic film material about the load board with the base sheet material and article on the sheet material; a means to move the load board within the curtain sequentially to a load station, a film wrap station and a film seal station for the removal of the film-tension wrapped packaged article on the sheet material, and to repeat the movement; and a thermoplastic film seal means to seal the leading and then the trailing end of the thermoplastic film about the article on the sheet material on the load platform to form a film about the article on the sheet material on the load board.

The invention will be described for the purpose of illustration only in connection with certain embodiments; however, it is recognized that those persons skilled in the art may make various changes, additions, deletions, and improvements without departing from the spirit and scope of the invention.

DETAILED DESCRIPTION

Figure 1A:
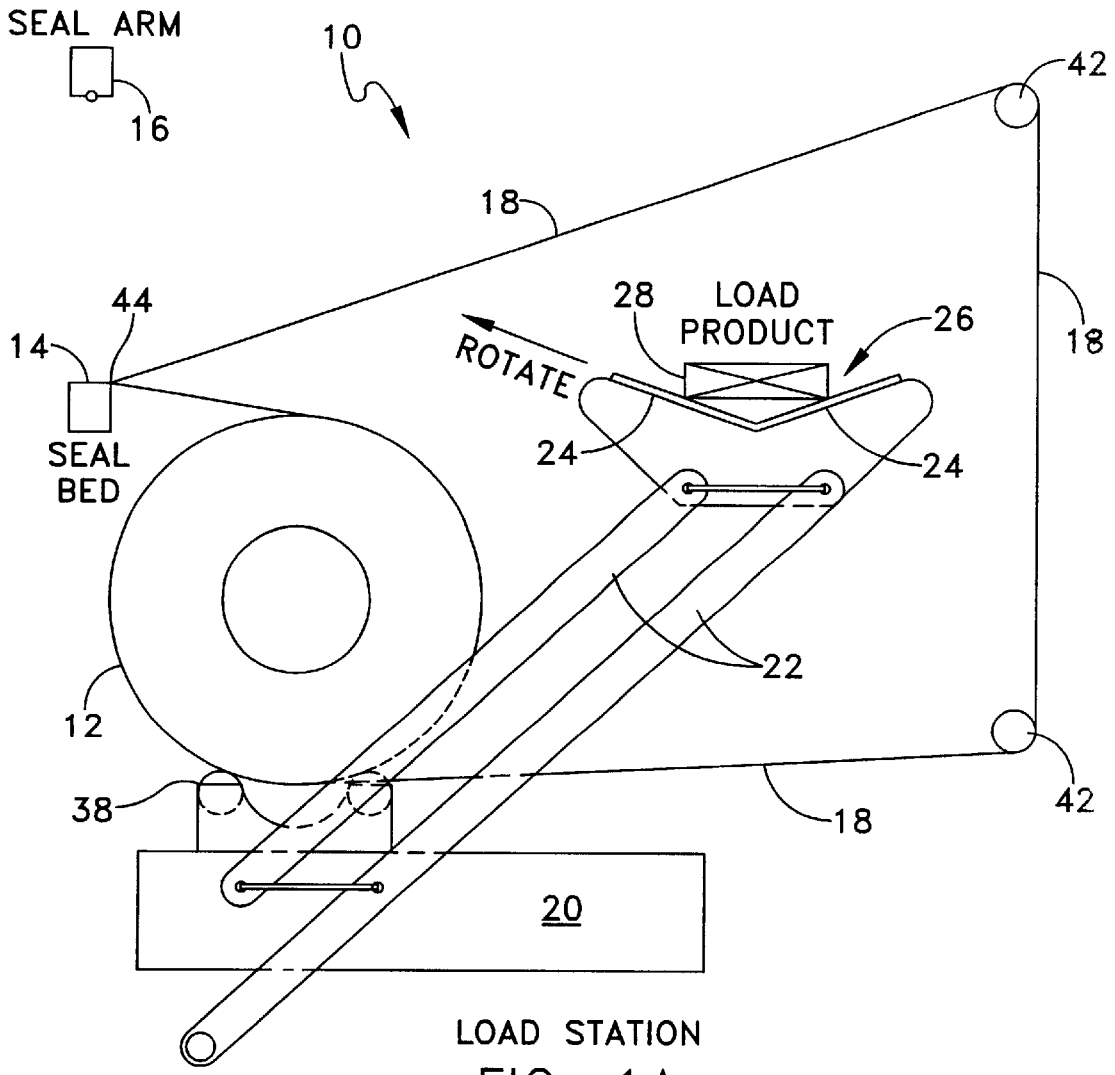
FIG. 1A is a schematic illustrative side plan view of the apparatus of the load station position.
Figure 1B:
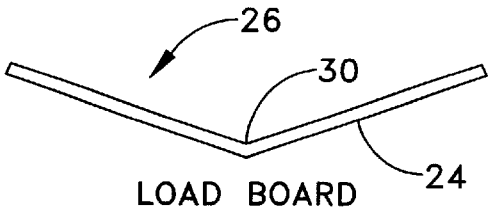
FIG. 1B is a representation of a V-shaped load board.
Figure 1C:
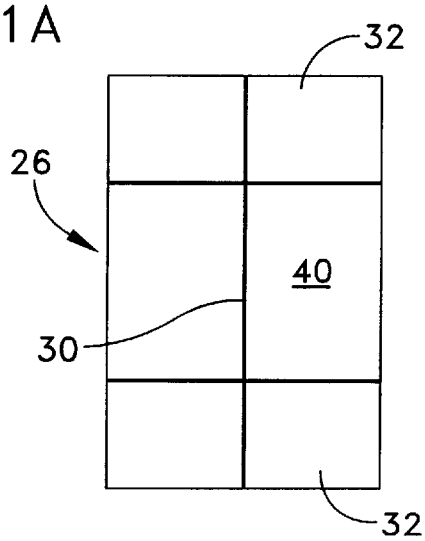
FIG. 1C is a top plan view of a sheet material with a base portion to receive the article to be packaged and as used at the load station.
Figure 2:
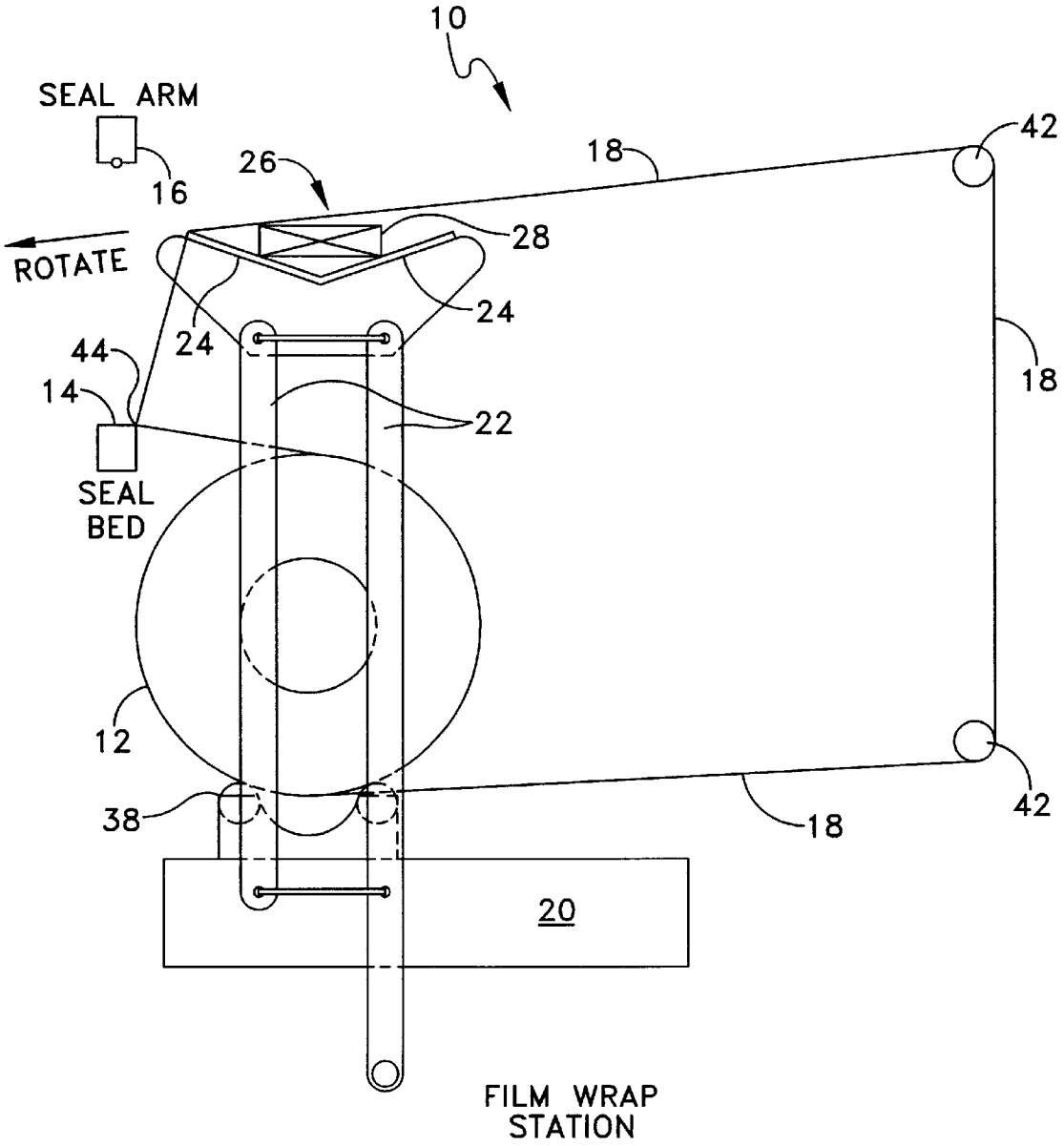
FIG. 2 is a schematic illustrational side plan view of the apparatus at the film wrap station.
Figure 3:
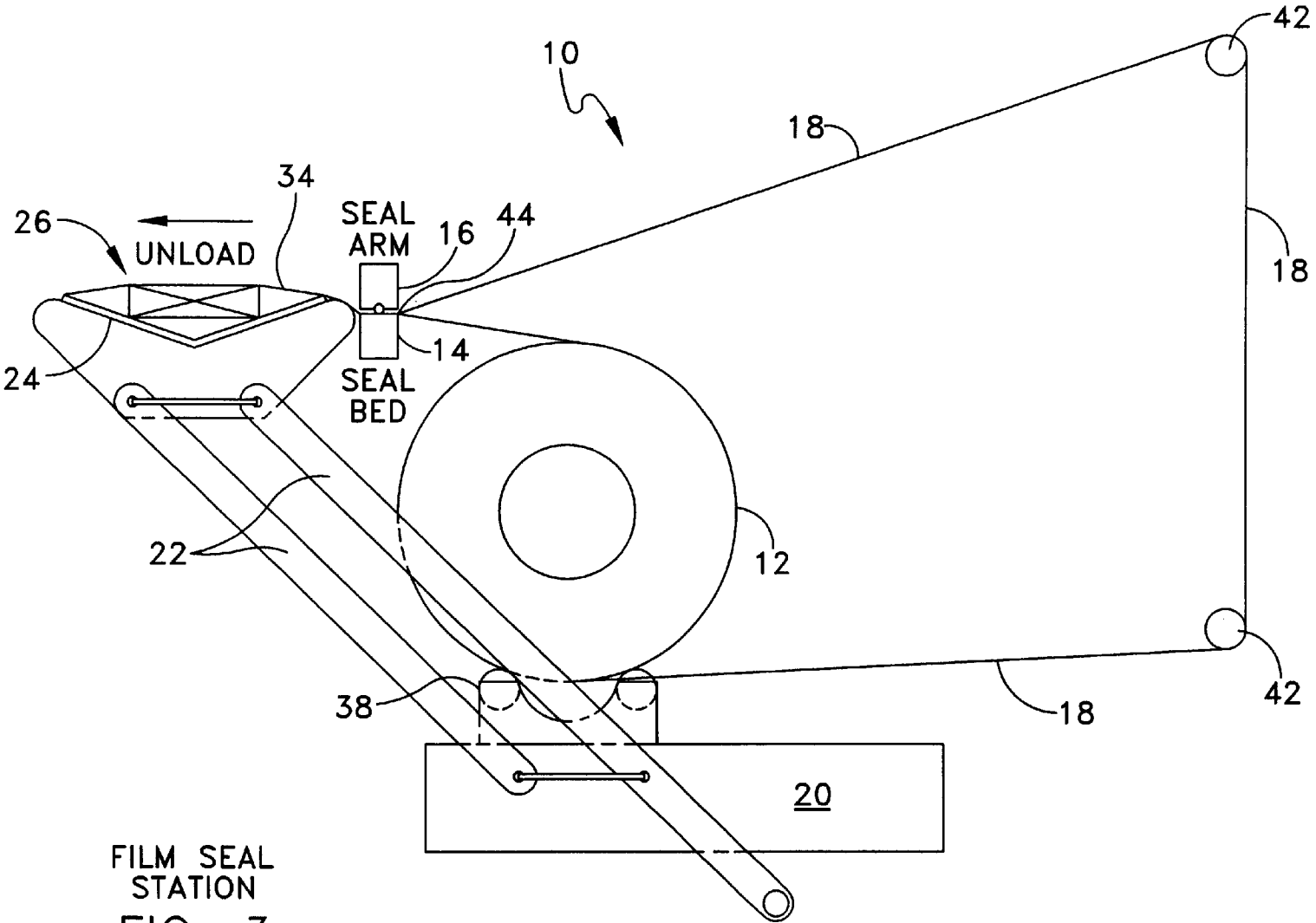
FIG. 3 is a schematic illustrational side plan view of the apparatus at the film seal station.

A packaging system is illustrated in three positions: load station, FIG. 1; film wrap station, FIG. 2; and film seal station, FIG. 3. Referring to FIG. 1A, the film material extends from the film source 12 over rollers 42 to a seal bed 14 where the film is heat sealed along line 44. The film as arranged forms a sealed film curtain 18. The system includes a seal bed 14 to heat seal the film and a seal arm 16. Preferably, the seal bed 14 is stationary and the seal arm 16 is moveable; alternatively, the seal bed 14 is moveable and the seal arm 16 is stationary. In any event, the seal bed 14 and seal arm 16 move relative to each other to form an open position, as shown in FIGS. 1A and 2, and a film heat seal position (FIG. 3). The heat sealing of the film material may be accomplished in various ways, but as illustrated employs a heat through a hollow tube or wire to heat seal the film, and cool air through the wire to immediately cool and solidify the heat line, thereby cutting the film, permitting removal of the packaged article (see e.g., U.S. Pat. No. 5,993,593, issued Nov. 30, 1999, hereby incorporated by reference).

After the film is formed at the film seal station the packaged article 28 on the base portion 40 of the base sheet material 26 on the load board 24 is removed, and the base sheet material 26 returned to a planar condition to tighten the film to have the film hug and immobilize the article 28. Optionally, the flaps 32 are then turned up or down resulting in further tension of the film around the film-wrapped, packaged article. Optionally, the film-wrapped, packaged article is placed in an outer container, for example a shipping box, crate or tube (not shown).

The film material can be stretchable; preferably, the film is elastic, so that after stretching, the film bounces back to assume tension around the article. The thickness of the film is chosen to optimize the elasticity and strength of the film in relation to the size and weight of the article to be packaged; the film material is preferably thick enough to prevent film breakage, thin enough to be stretched as the film is wrapped around the article, and elastic enough to bounce back and to provide the desired film tension to immobilize the article on the base portion of the package. Film materials useful in the invention are preferably, e.g., 1–5 mil, or 2–3 mil, up to 6 mil in thickness (where one mil is equivalent to 0.001 inches). The film can also be heat labile, for example, a thermoplastic, polymeric sheet material. The film material is capable of being sealed at the edges so that by closing the edges the film forms a sealed film curtain, film roof or film tube. Types of film materials are known to those of skill in the art, such as, for example, polyethylene, polypropylene, polyurethane, vinyl, or other suitable polymer films. Additional film materials include metaocene, olefin, and modified versions of styrene. Transparent film is preferred when see-through packaging is desired. Alternatively, the film material may be translucent or opaque and may be colored or colorless.

In an alternative embodiment, the film surrounding the film-packaged article can be heat shrunk after sealing, before or after removing the packaged article from the system, so that the film further conforms to the shape of, or applies additional tension around, the packaged article. Where it is desired to use a film that is heat shrinkable, suitable film materials include, without limitation, olefin, polyvinylchloride, and polyurethane.

The source of film material is wound on a roll. Single layers of film are wound about a roll to become a single wound roll, or double layers of film are wound about a roll to become a double wound roll. Where the film source, or roll source, is a double wound roll, the layers of film are sealed to each other lengthwise along one or both side edges of the film.

Where the film source is a single wound roll it is desirable for the system to include two roll sources of film, one roll providing a source of film material for under the base sheet material, and the second roll providing a source of film material for wrapping over the top of the article to be packaged, both rolls together providing a film curtain. Film materials suitable for the invention are commercially available from, e.g., Dow Chemical Co. (Metallocene™), or IVEX.

The apparatus 10 comprises a film source 12 of a thin, usually transparent polymer film material resting on at least one, or two or more, preferably a pair, of rotatable support rollers 38 to permit the unwinding of the film material from the film source 12 during operation of the apparatus 10. The operation can be carried out in either separate or, preferably, simultaneous stages of heating, sealing and cutting.

The base is typically a sheet material such as a scored rectangular cardboard sheet. Alternatively, the base sheet material can be plastic or fiber board. Referring to FIG. 1C, the base sheet material is generally characterized by a central or off-center longitudinal fold line 30, or by a pair, or by three or more, longitudinal fold lines 30. Where there are two or more longitudinal fold lines 30, the longitudinal fold lines 30 are preferably parallel. The sheet material 26 also includes one or more spaced apart, transverse fold lines at each end of the base sheet material. Preferably, the transverse fold lines can be parallel.

Load board 24 can be either planar, V-shaped, or angular (see FIG. 1B). The load board 24 receives base material 26 thereon (see FIG. 1C). The base material 26 is generally a sheet material, such as a cardboard sheet with a base portion 40 on which an article 28 is to be placed to be packaged. As shown in FIG. 1C, a longitudinal fold line 30 is centrally positioned on the base sheet material 26. In other embodiments, the longitudinal fold line 30 can be positioned off-center, or may include a pair of spaced apart parallel fold lines, for example, on either side of the central longitudinal axis of the base sheet material 26. The base sheet material can further include transverse fold lines which, when folded upward or downward, form end flaps 32 (see FIG. 1C) on the base sheet material 26.

Referring again to FIG. 1A, the apparatus 10 includes a pivotal arm 22, preferably two or more pivotal arms 22, extending from one end of a motor 20. By motor is meant an electric motor, a pneumatic motor, a rotary motor, e.g., a rotary accuator, or an air cylinder. The pivotal arm(s) support the load board 24 (angular as illustrated) at the other upper end of the arm(s). The arms 22 are pivoted to move within the film curtain 18 in sequence from a load position, wherein the article 28 is placed on the base portion 40 of the base material 26 on the load board 24 (FIG. 1A); a film wrap position, wherein the arms 22 and the load board 24 are moved above the film source 12 to extend film material 18 over the top of the article 28 (FIG. 2); and a film seal position wherein the pivotable arms 22 and the load board 24 are moved to the other side of the film source 12 and the film is sealed on one edge, the heat seal edge 44, about the article 28 and base sheet material 26, the other edge of the film, e.g., the leading edge, previously heat sealed in the prior operation, all within the sealed film curtain 18.

In FIG. 2 the load board 24 is rotated through the sealed film curtain 18 so that the film is stretched to a desired film-tension based on the height of the article 28 over the top surface of the load board 24.

In FIG. 3 the load board 24 is further rotated to the opposite sides of the seal arm 16 and seal bed 14 and the seal arm 16 moved into contact with the seal bed 14 to seal and form a sealed cut film 34 on the trailing edge of the film on the opposite side and above the film source 12 and outside of the film curtain 18. The packaged article 28 is then removed from the load board 24, either by manual or by automated means.

Figure 4:
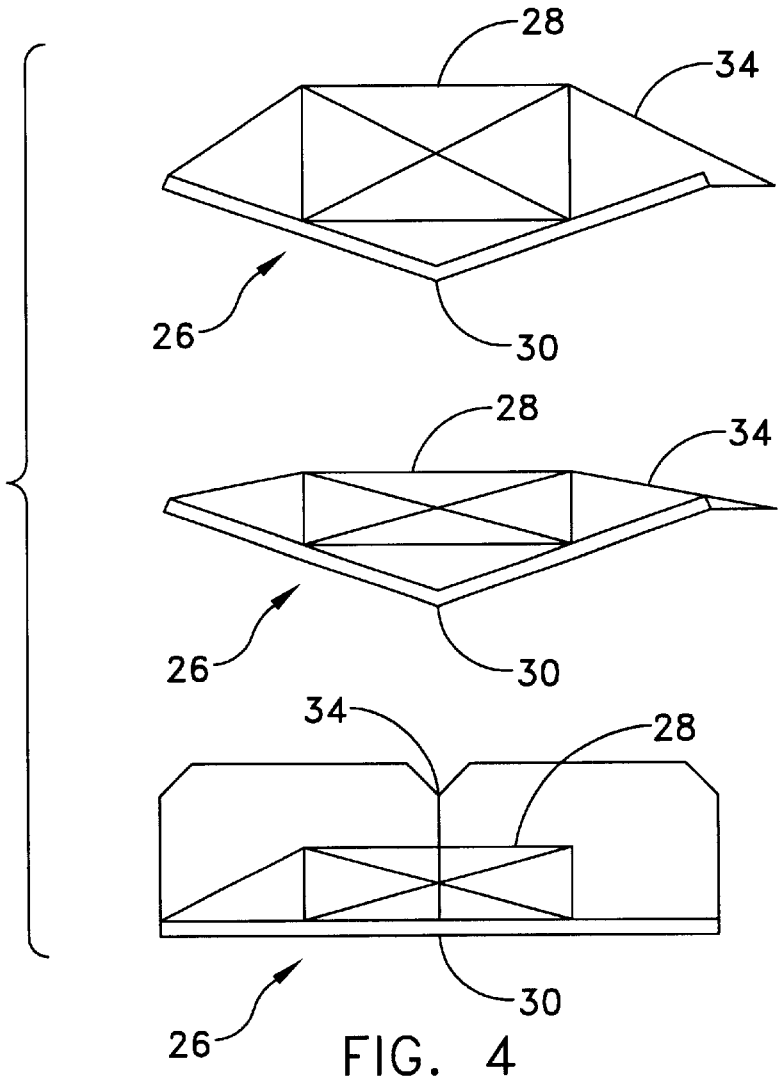
FIG. 4 is a schematic representation of a sheet material and immobilized article illustrating the successful packaging of articles of different heights by the system of the invention.

FIG. 4 illustrates, in three package embodiments, that articles 28 of different heights may be packaged within a film by the system of the invention. Where an article 28 is tall, a larger amount of film is required to surround the article 28, resulting in the in situ formation of a larger sealed film 34. Where an article 28 is relatively short, the film curtain is correspondingly smaller, resulting in a smaller sealed film 34. Thus, the packaging system of the invention is able to adjust to the relative size and shape of various articles to be packaged, while maintaining an even film-tension.

The packaging system of the invention can further adapt to various sizes and shapes of articles by altering the shape and size of the base 26, and by the configuration of fold lines thereon.

The process of the invention can be repeated so as to package multiple articles 28 in serial or sequential fashion. After packaging an article 28, the load board 24 is moved back to the load station position, and the seal bed 14 is returned to the open position, returning the system to its initial or original configuration, ready to package an additional article 28. Multiple articles 28 of the same kind or type may be packaged by the system of the invention within a series of operations. Alternatively, the system and process of the invention can package articles of different sizes and shapes within a series of operations.

Figure 5:
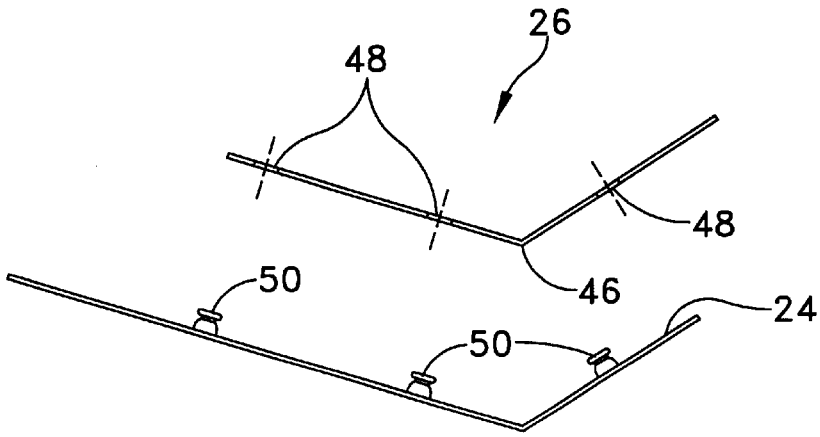
FIG. 5 is another embodiment of the invention showing a load board and a sheet material to be secured to the board.

FIG. 5 is a schematic illustration of another embodiment of the invention having a V-shaped, off-center load board 24. The surface of the load board 24 has a plurality of spaced pegs 50 thereon, and the base 26 has an off-center, longitudinal fold line and a plurality of holes 48 which may be manually inserted into the pegs to hold the base 26 in position through the operation. Alternatively, as a substitute for pegs 50, the base sheet material 26 can be secured to the load board 24 with pins, or clips, or other type of fastener known to those skilled in the art. Preferably, the fasteners position the base sheet material 26 in close proximity to the seal arm.

What is claimed is:

1. A system for packaging an article in film, which system comprises:

a) an article load station which comprises:

i. an arm having a first end and a second end and arranged and constructed at said first end to move between a product load station, a film wrap station, and a film seal station; and ii. an article load platform at said second end of said arm to receive a product base thereon and to receive a product to be packaged on the platform-supported product base;

b) a film wrap station which comprises:

a roll source of a thermoplastic film material to be used to tension-film wrap the product on the product base supported on said platform at the film wrap station, the film material from the roll arranged and constructed to form a film curtain about the said platform at the product load station and film wrap station and to extend the film material in a stretched tension position over the top of the product and base at the film wrap station;

c) a film seal station which comprises:

a seal bed and a seal arm which move between an open, non-seal position to permit the passage of film material and a closed, seal position to seal the film material and form a film about the product and product base and to sever the sealed film material at a trailing end of the film material to provide a film-wrapped product and to form a sealed leading edge of the film material for the next product to be packaged; and d) means for moving the arm sequentially between said stations with said platform spaced apart from one side of the roll source and within the film curtain at the product load station; said platform, product base, and product are positioned generally directly over the roll source at the film wrap station, and whereby the film material is tension-stretched over the product and product base at one edge of the product and over another edge of the product as the arm moves to the film seal station; a film wrapped product on said platform is spaced apart on the other side of the roll source to permit the trailing edge of the film material to be sealed and cut to produce a film wrap over the product and product base.

2. The system of claim 1 wherein the platform has a V shape.

3. The system of claim 1 wherein the platform comprises two adjacent platforms.

4. The system of claim 1 wherein the seal bed and seal arm in the seal position heat seal two layers of the film material together.

5. The system of claim 1 wherein the thermoplastic film material comprises an olefin polymer film material.

6. The system of claim 1 which includes a plurality of film rollers to support the film material and to form the film curtain and extending from the roll source to the sealed film material at the seal bed.

7. The system of claim 1 which includes a product base on said platform.

8. The system of claim 7 wherein the product base comprises a rectangular cardboard having at least one longitudinal fold line and two traverse, opposite end flaps with traverse fold lines.

9. The system of claim 1 which further includes a sheet material for use with the system, which sheet material has a longitudinal fold line, a pair of opposite end flaps defined by traverse fold lines, and a base portion to receive an article to be packaged.

* * * * *